United States Patent [19]

Pagdin et al.

[11] Patent Number: 5,016,588

[45] Date of Patent: May 21, 1991

[54] THROTTLE ACTUATOR AND CONTROL SYSTEM

[75] Inventors: Brian C. Pagdin; Alastair M. McQueen, both of Birmingham, Great Britain

[73] Assignee: Lucas Industries Public Limited Company, Birmingham, England

[21] Appl. No.: 532,070

[22] Filed: Jun. 1, 1990

[30] Foreign Application Priority Data

Jun. 1, 1989 [GB] United Kingdom ..... 8912537

[51] Int. Cl.[5] ..... F02D 11/10

[52] U.S. Cl. ..... 123/399; 318/599; 251/129.11

[58] Field of Search ..... 123/361, 399, 585; 251/129.11, 129.12; 318/599, 606

[56] References Cited

U.S. PATENT DOCUMENTS

| | | | |
|---|---|---|---|
| 4,639,624 | 1/1987 | Ejiri et al. | 123/585 X |
| 4,675,589 | 6/1987 | Sausner et al. | 318/606 X |
| 4,721,176 | 1/1988 | Kabasin et al. | 123/399 X |
| 4,819,597 | 4/1989 | Gale et al. | 123/399 |
| 4,850,322 | 7/1989 | Uthoff et al. | 123/399 |
| 4,900,998 | 2/1990 | Shyi | 318/599 |

*Primary Examiner*—Willis R. Wolfe

*Attorney, Agent, or Firm*—Dvorak and Traub

[57] ABSTRACT

An actuator for the throttle of an internal combustion engine comprises a torque motor and a return spring. The spring provides a monotonically increasing return force for increasing throttle opening. The motor has a torque characteristic such that, for constant motor current, the torque decreases monotonically for increasing throttle opening. The actuator thus has a single-valued function of throttle position versus motor current and allows open loop control as well as stable closed loop control.

5 Claims, 6 Drawing Sheets

THROTTLE ACTUATOR AND CONTROL SYSTEM

The present invention relates to a throttle actuator and to a control system for a throttle including such an actuator. Such an actuator and a system may be used to control the position of a throttle, for instance a butterfly valve, in the induction system of an internal combustion engine, for instance of a vehicle.

The tendency in modern control systems for internal combustion engines in vehicles is to replace mechanical linkages between driver-actuated load demand devices (such as accelerator pedals) and engine control devices (such as throttles in fuel injection or carburetor systems) with "drive-by-wire" arrangements. In such drive-by-wire arrangements, the accelerator pedal is connected to a position transducer whose output signal represents the accelerator pedal position. The transducer output signal is processed by analog and/or digital control electronics, frequently including a microcomputer, whose output signal drives an actuator, such as a torque motor which controls the degree of opening of the engine throttle. Usually, the engine throttle is mechanically connected to another position transducer whose output represents the actual throttle position. This signal is used as a feedback signal to the control electronics, which provides closed loop servo control of the throttle by comparing the actual throttle position with a demanded position.

In order to provide failsafe operation of such an arrangement, the torque motor acts against a return spring which urges the throttle shut. The parameters of the return spring are chosen such that the return spring closes the throttle in the event of various failures in the arrangement. For instance, these parameters may be chosen such that the torque exerted on the throttle in its closed position is sufficient to ensure that the throttle is closed against a short-circuited torque motor in less than one second. However, the return spring parameters are limited by the need to limit torque motor current to a maximum value, typically 3.5 amps at room temperature with the throttle fully open. In order to provide a stable closed loop servo control system for the throttle, open loop stability of the system i.e. without throttle position feedback, is desirable. It is also desirable for the system to be able to function, albeit with reduced accuracy, if a fault occurs such that throttle position feedback is lost.

GB-A-1352127 and GB-A-1480590 disclose a particular construction of torque motor and its use in controlling a combined fuel pump and valve arrangement in order to control the quantity of fuel injected in a fuel injection system. However, the combined fuel pump and valve arrangement does not have any return spring or other means for biasing the torque motor to a rest position and, instead, relies on working against fuel pressure which tends to close the valve.

According to a first aspect of the invention, there is provided a throttle actuator comprising a throttle which is pivotable over a range of angular positions between a closed position and a fully open position, a return spring biasing the throttle towards the closed position, and a torque motor for driving the throttle, the actuator having a single-valued transfer function of throttle angular position against torque motor current over the range of angular positions of the throttle.

Preferably, the return spring provides a throttle-closing bias force which increases monotonically with increasing angular displacement of the throttle from the closed position, and the torque motor has a transfer characteristic of torque against throttle angular position such that, for each value of torque motor current less than or equal to a predetermined maximum value, motor torque decreases monotonically with increasing angular displacement of the throttle from the closed position.

Preferably the torque motor produces zero torque for zero torque motor current throughout the range of throttle angular positions.

According to a second aspect of the invention, there is provided a throttle control system comprising a throttle actuator according to the first aspect of the invention and a control circuit for controlling the actuator in accordance with a demand signal.

Preferably, the actuator includes a throttle position transducer, such as a potentiometer, for supplying to the control circuit a signal representing actual throttle position and the control circuit is arranged to drive the torque motor in accordance with the difference between the actual throttle position and a demanded throttle position corresponding to the demand signal. Although the demanded throttle position could be a simple linear function of the demand signal, in general the demanded throttle position will be a more complex function of the demand signal, for instance from an accelerator pedal position transducer, and various other parameters related to internal combustion engine operation and possibly also to vehicle operating parameters such as vehicle speed and transmission ratio. Thus, the control system may form part of a complete engine management system or a comprehensive system managing engine, transmission, and other vehicle parameters.

It is thus possible to provide a throttle actuator and a control system which have stable open loop operation and which therefore allow stable closed loop operation to be achieved. Also, if a failure occurs in the closed loop such that throttle position feedback is lost, the actuator and control system can continue to function in open loop mode.

The invention will be further described, by way of example, with reference to the accompanying drawings, in which.

Figure 1:
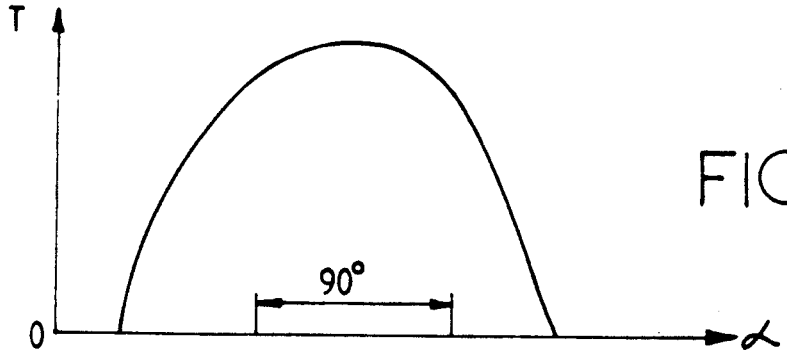
FIG. 1 is a graph of a typical transfer function of torque T against angle $\alpha$ for a typical torque motor.

FIG. 1 illustrates the transfer characteristic of torque T against angle $\alpha$ of a typical torque motor of known type. The shape of this transfer characteristic or function closely approximates a half cycle of a sine function. When used as part of a throttle actuator for an internal combustion engine to control the position of a throttle butterfly in a fuel injection or carburetor induction system, the torque motor is only required to act over a 90° range of movement or angular positions with the extremes of this range corresponding to the fully closed and fully open positions of the throttle. In order to make use of the range of greatest torque outputs of the motor, the motor is arranged so that this 90° range falls within the characteristic as shown in FIG. 1.

Figure 2:
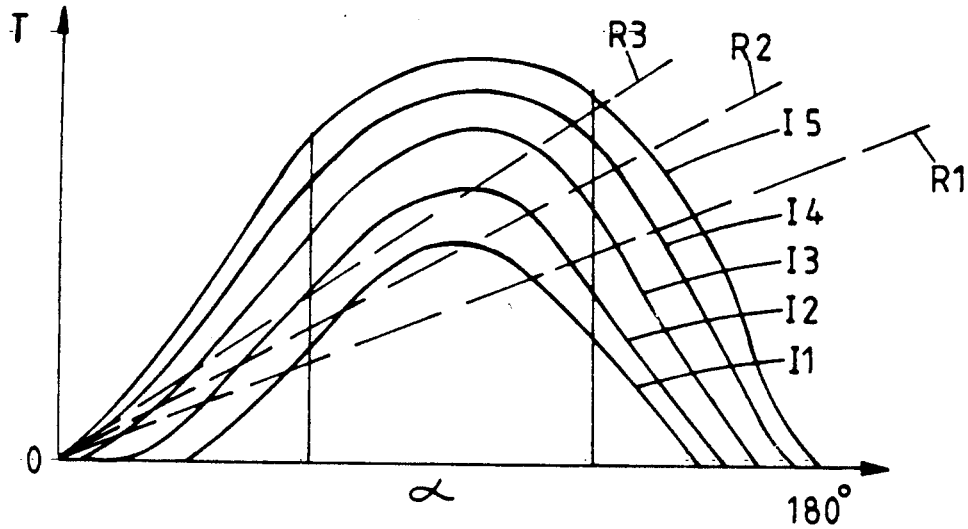
FIG. 2 shows a family of transfer functions of the type shown in FIG. 1 with torque motor current as parameter.

FIG. 2 illustrates a family of transfer functions of the type shown in FIG. 1 corresponding to different torque motor currents from a lowest current $I_1$ to a highest current $I_5$. In general, the torque motor current is required to be less than a maximum value for internal combustion engine applications in vehicles, and this maximum value corresponds to the current $I_5$. In addition to a torque motor, a throttle actuator includes a throttle return spring which biases the throttle towards its closed position. Such return springs typically apply a return torque which increases linearly with increasing throttle angle displacement from the closed position. Three typical return spring characteristics are illustrated by broken lines $R_1$, $R_2$, and $R_3$ in FIG. 2 representing low, medium, and high spring strengths, respectively.

Figure 3:
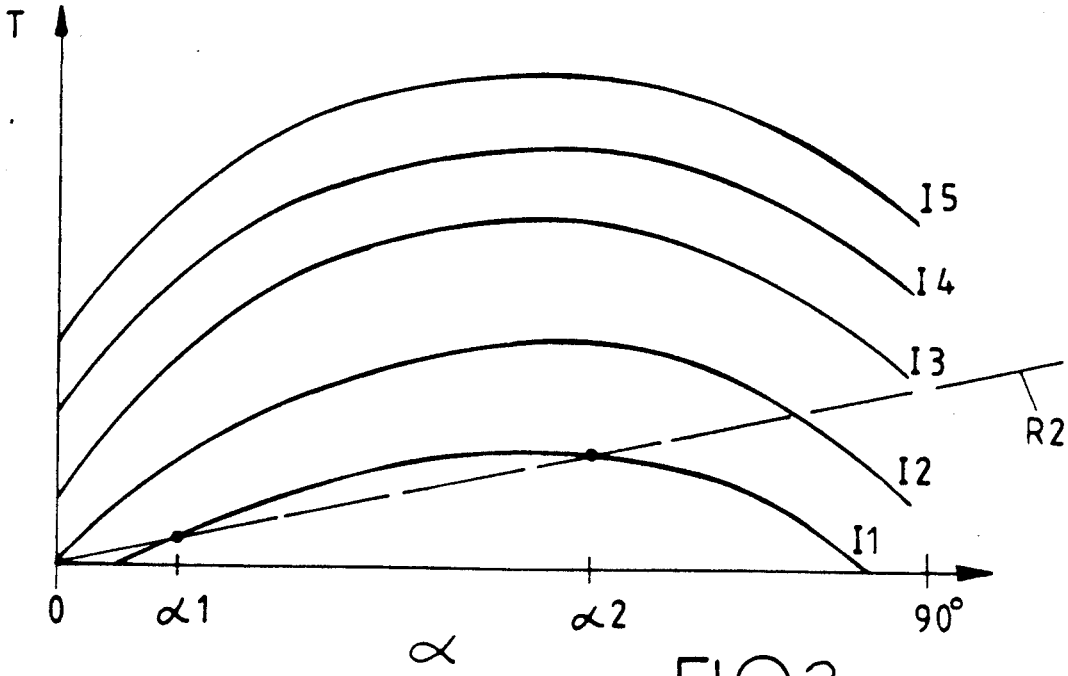
FIG. 3 shows part of the family of transfer functions of FIG. 2 for a typical working range of the torque motor.

FIG. 3 illustrates the torque motor transfer function family of curves to a larger scale for the actual 90° range which is normally used in conventional throttle actuators, together with the return spring function $R_2$. The peak portions of the various curves are used so as to make use of the range of largest motor torques. This is generally necessary in order to allow the torque motor to provide sufficient torque to act against the return spring, whose strength has to be sufficient to ensure that the throttle is closed in the event of a fault in the control system for the throttle. In general, the worst case fault would be short-circuiting of the torque motor so that the return spring has to be sufficiently strong to close the throttle against the braking effect of the motor from any throttle position within a specified time, for instance one second. However, this can cause a problem during normal operation of the actuator illustrated by the fact that the return spring characteristic $R_2$ crosses the torque motor function for a torque motor current of $I_1$ at two angular positions, namely $\alpha_1$ and $\alpha_2$. This can lead to unstable operation of a throttle control system, particularly during closed loop operation in which a throttle position feedback signal is used in a closed loop servo control arrangement. Although the closed loop control may be arranged to operate stably, a problem can arise in the event of a failure in the control system which causes loss of the throttle position feedback. If such a fault were to occur, it would be desirable for the control system to continue to function in open loop operation. However, because there are two throttle angle positions $\alpha_1$ and $\alpha_2$, corresponding to the torque motor current $I_1$, the throttle may adopt either of these positions during open loop control when the torque motor passes the current $I_1$. Clearly, this is undesirable and can make a vehicle using such a control system undrivable in the open loop mode.

Figure 4:
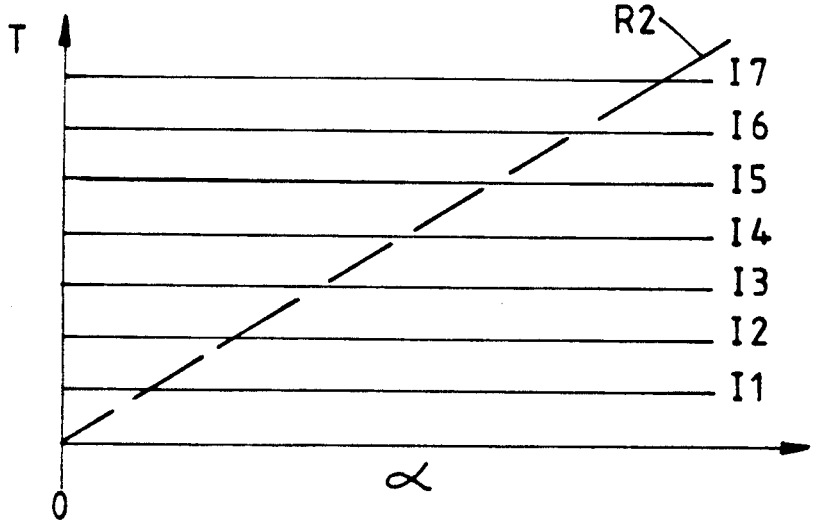
FIG. 4 shows an ideal family of torque motor transfer functions for an actuator according to the invention.

In order to avoid this problem, the torque motor transfer function should be a single valued function within the angular range of operation of the throttle. FIG. 4 illustrates a family of ideal torque motor transfer functions, in which, for each of the currents $I_1$ to $I_7$, the torque motor provides a constant torque T for all angles $\alpha$. The return spring function $R_2$ thus intersects each of the isotorque curves at only one point so that stable closed loop operation can readily be achieved and, in the event of failure, open loop operation is also possible. However, it has so far been impossible to provide torque motor characteristics of this type.

Figure 5:
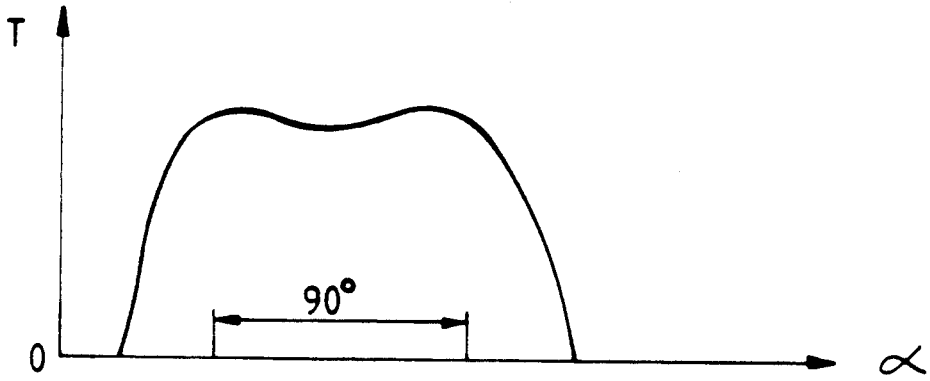
FIG. 5 is a graph of a practical torque motor transfer function approaching the ideal.
Figure 6:
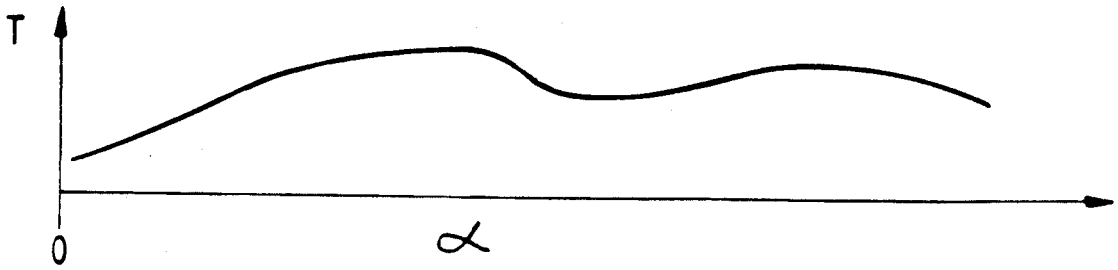
FIG. 6 illustrates the transfer function of FIG. 5 more clearly.

FIG. 5 illustrates one way in which a torque motor transfer function can be altered to resemble the isotorque curves illustrated in FIG. 4. By modifying various parameters of the torque motor, the single peak of the sine function shown in FIG. 1 is replaced by two peaks separated by a relatively shallow trough. The 90° working range is illustrated in more detail in FIG. 6, from which it can be seen that typical return spring characteristics may well intersect the torque characteristic at more than one point. Stable closed loop operation and correct open loop operation of a control system using a torque motor having this type of characteristic cannot therefore be guaranteed.

Figure 7:
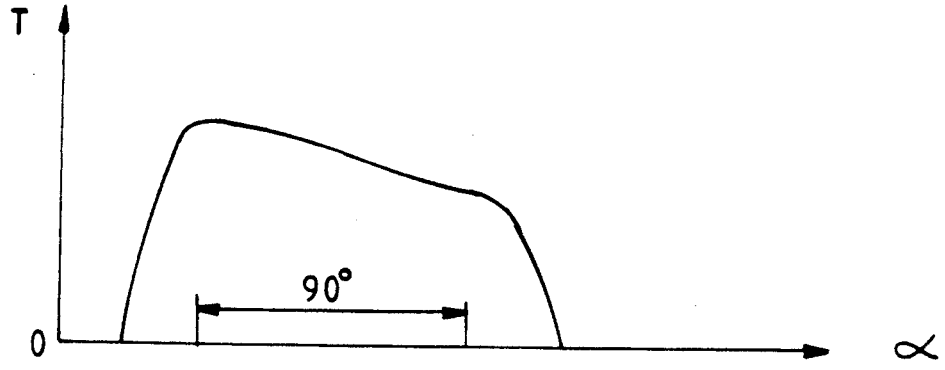
FIG. 7 illustrates the transfer function of a torque motor for use in an actuator constituting a preferred embodiment of the invention.
Figure 8:
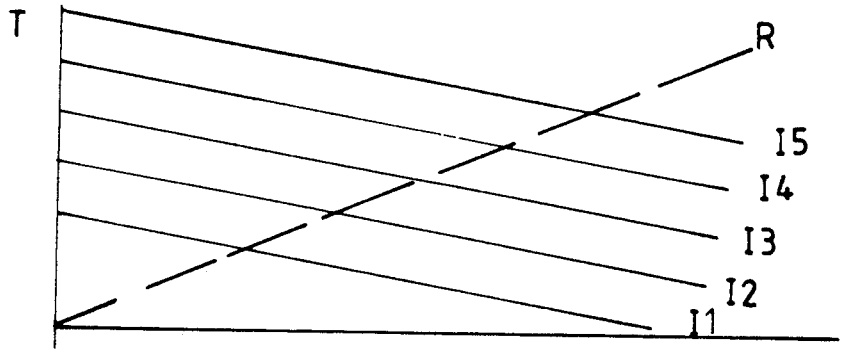
FIG. 8 shows part of the range of a family of torque motor transfer functions of the type shown in FIG. 7 with torque motor current as parameter.

FIG. 7 illustrates a torque motor transfer function which has actually been achieved and which provides a torque motor suitable for a throttle actuator. This transfer range has a single peak near to the left of the function followed by a monotonically falling portion. Over the angular range of the throttle, this transfer function resembles a linearly monotonically decreasing function of torque with respect to angle and a family of functions for different torque motor currents $I_1$ to $I_5$ is shown in FIG. 8 for the working range with a typical return spring function R shown by the broken line. The return spring function R intersects each of the curves of torque against angle at a single point and therefore allows a throttle actuator to be made which can function stably in a closed loop system and permit open loop operation.

Figure 9:
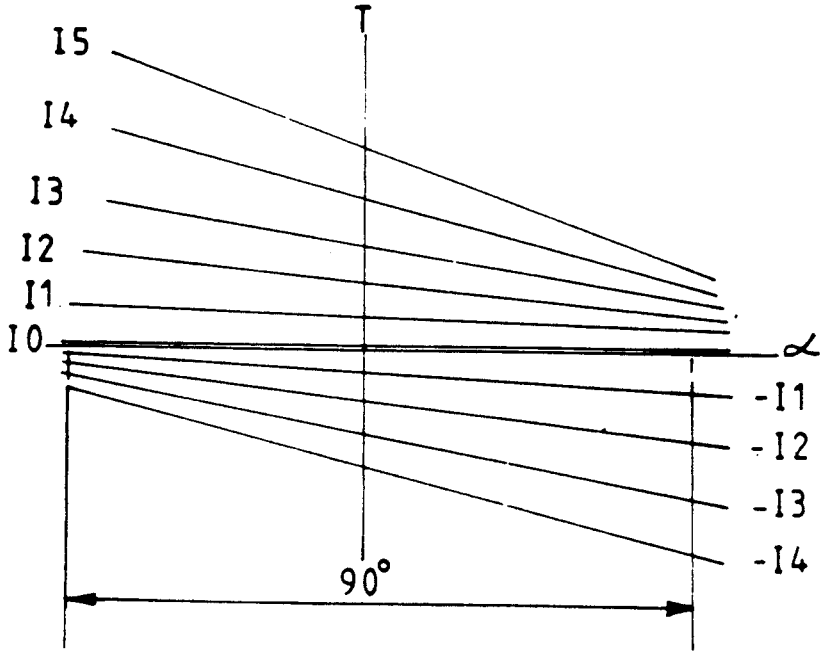
FIG. 9 is similar to FIG. 8 but shows curves for zero and negative torque motor current.

The horizontal axis in FIG. 8 is displaced upwardly from the zero-torque position and does not show the behavior of the torque motor for zero current. However, for stable operation of the throttle actuator particularly under open loop operation, the torque motor should produce zero torque at all angular positions within the angular range of operation for zero motor current. FIG. 9 illustrates a family of transfer functions which achieves this and which can be obtained in practice. The function for zero motor current $I_0$ is a horizontal line representing zero motor torque (shown displaced slightly above the horizontal axis for clarity).

As is also clear from FIG. 9, the transfer function is substantially symmetrical through the origin so that the curves for positive and negative currents of the same absolute value have the same shape but are rotated about the origin by 180° with respect to each other. The slopes of the curves become smaller as the absolute value of the motor current decreases, the slope being zero for zero motor current $I_0$.

Figure 10:
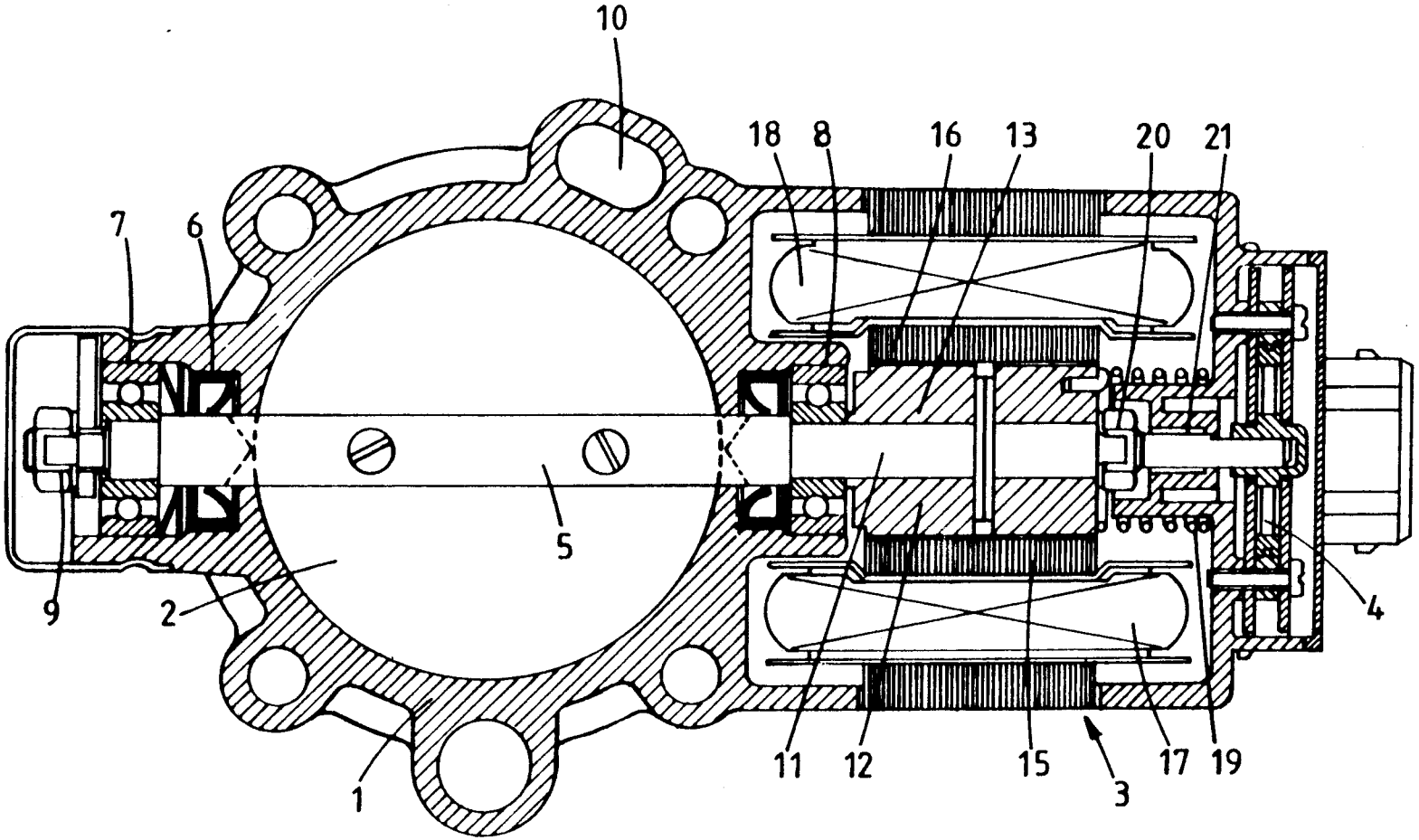
FIG. 10 is a cross-sectional view of a throttle actuator constituting a preferred embodiment of the invention.

FIG. 10 shows a throttle actuator including a torque motor having a transfer function of the type shown in FIGS. 7 and 9. The actuator comprises a housing 1 containing a throttle butterfly 2, a torque motor 3, and a throttle position transducer in the form of a potentiometer 4. The throttle butterfly 2 is fixed to a spindle 5 which passes through holes in the housing 1 provided with seals 6. The part of the housing containing the throttle butterfly 2 is in the form of a pipe or tube for forming part of the induction system of an internal combustion engine, for instance in a vehicle. The spindle 5 is supported in ball bearings 7 and 8 and one end of the spindle is provided with a thrust bearing 9.

Various bores are provided in the housing 1, including an air by-pass 10 for idling operation of the engine.

The spindle 5 is rigidly connected to or integral with a shaft 11 of the torque motor 3. The shaft 11 carries permanent magnets 12 and 13 which co-operate with pole pieces 15 and 16 forming part of a stack of laminations providing a magnetic circuit for the motor. Windings 17 and 18 are provided around the limbs of the stack of laminations extending from the pole pieces 15 and 16, the windings being connected in series for connection to a suitable source of driving current.

The motor shaft 11 extends beyond the motor 3 away from the throttle butterfly 2 into a chamber containing a return spring 19. The return spring 19 acts between the magnet 13 and the housing 1 so as to bias the throttle butterfly 2 towards its closed position as illustrated in FIG. 10. A thrust bearing 20 and a plain bearing 21 are arranged near the end of the motor shaft 11, which is connected to the wiper of the potentiometer 4.

Figure 11:
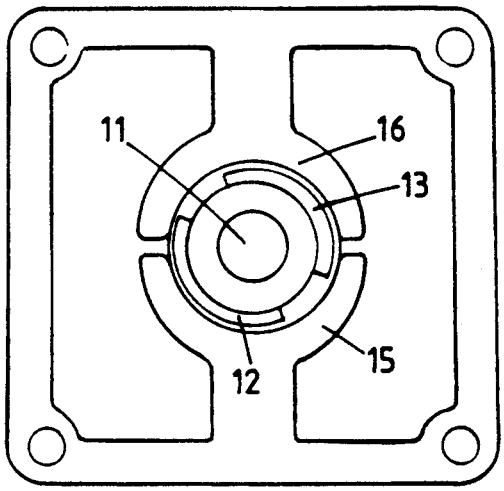
FIG. 11 is a transverse sectional view of a torque motor of the actuator of FIG. 10.
Figure 12:
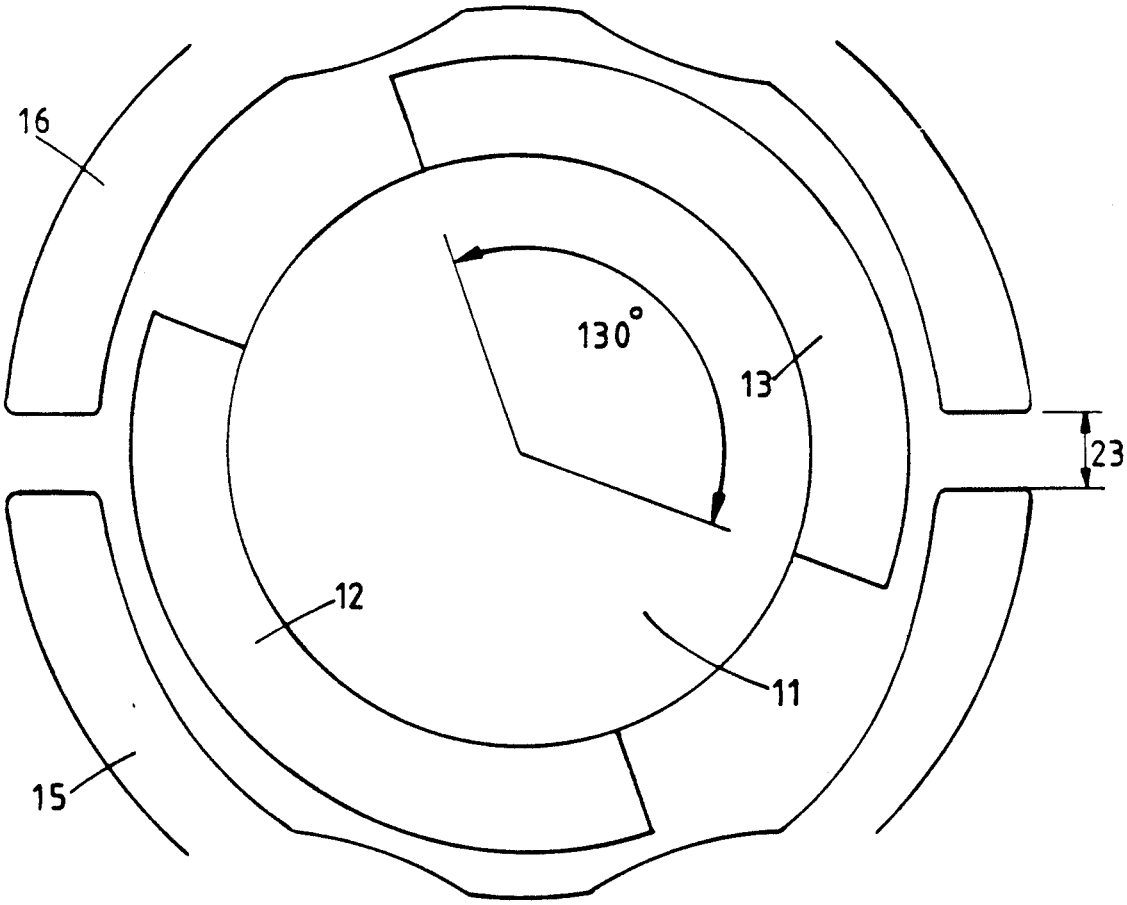
FIG. 12 is an enlarged view of a detail in FIG. 11.

In order to provide the desired transfer function of the torque motor 3, the permanent magnets 12 and 13 and the pole pieces 15 and 16 are arranged as illustrated in FIGS. 11 and 12. In particular, FIG. 12 is a scale drawing from which the shape and various dimensions of the parts of the motor can be seen. Thus, the permanent magnets 12 and 13 are arranged diametrically opposite each other on the shaft 11 and each of the magnets is shaped as part of an annulus subtending an angle of 130°. The outside diameter of these magnets is 24.85 mm and the actual angular positions of the magnets on the shaft 11 in relation to the orientation of the throttle butterfly 2 on the spindle 5 are such as to make use of the 90° angular range of the transfer function as illustrated in FIG. 7.

The bifurcated pole pieces 15 and 16 extend around the rotational paths of the magnets 12 and 13 and the adjacent ends of the pole pieces are separated by a gap 23 of 2.34 mm. The nominal air gap between the pole pieces and the magnets is 0.8 mm but the faces of the pole pieces facing the magnets are profiled as shown in FIG. 11 to provide a maximum air gap of 1.46 mm and a minimum air gap of 0.7 mm.

Figure 13:
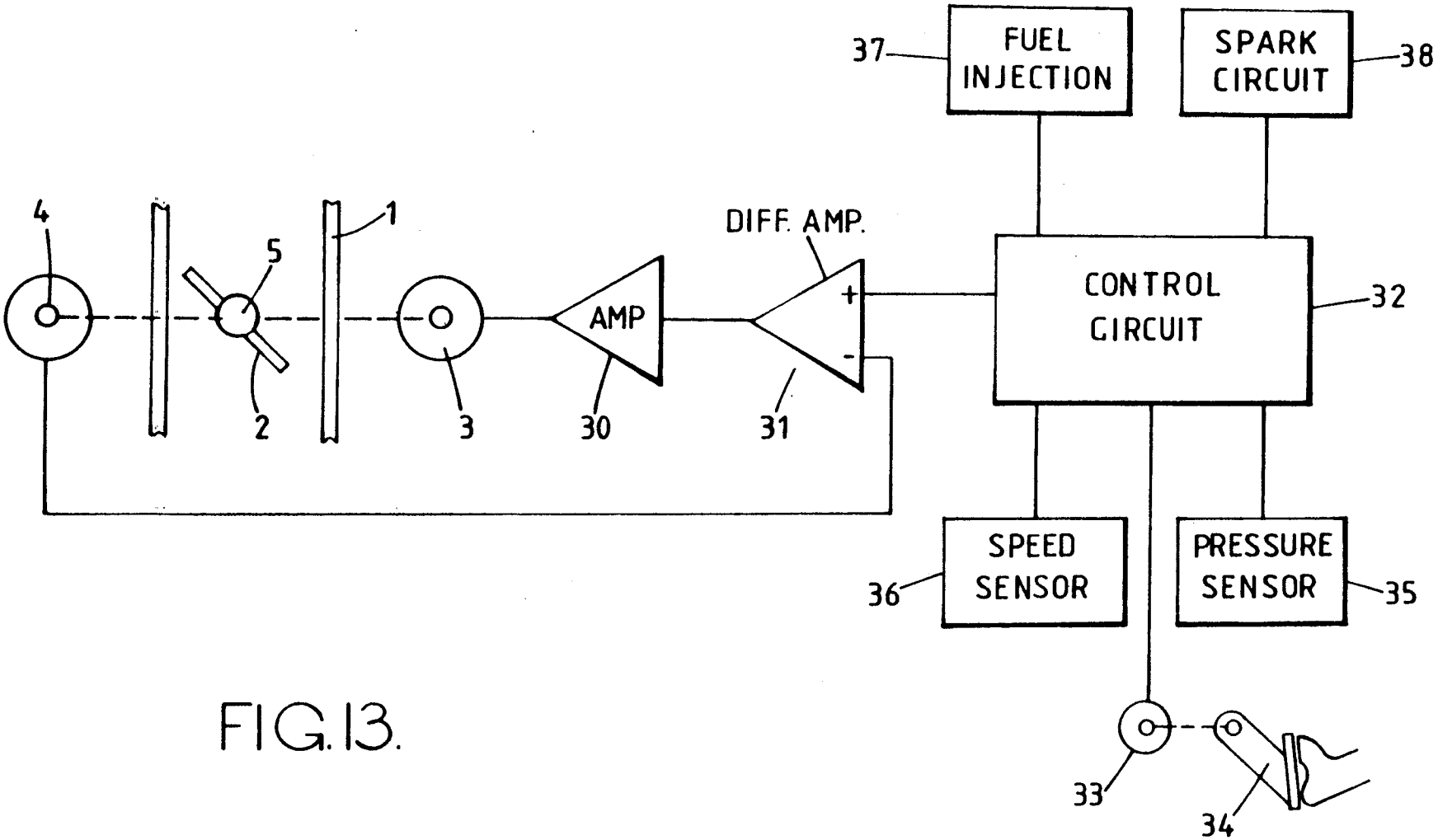
FIG. 13 is a block schematic diagram of a throttle control system constituting a preferred embodiment of the invention and incorporating the actuator of FIG. 10.

FIG. 13 is a block schematic diagram of a control system for the actuator shown in FIG. 10. The motor is connected to the output of a drive amplifier 30 whose input is connected to the output of a differential amplifier 31. The differential amplifier 31 has an inverting input connected to the throttle position sensing potentiometer 4 and a non-inverting input connected to a control circuit 32. The control circuit 32 is arranged to supply throttle position demand signals to the differential amplifier 31.

The control circuit 32 has an input connected to a potentiometer 33 which is mechanically connected to an accelerator pedal 34 and which provides signals representing the position of the accelerator pedal. The control circuit has an input connected to a pressure sensor 35 provided in the induction manifold of the engine for supplying signals representing the manifold depression. The control circuit 32 has input connected to a speed sensor 36 for providing a signal representing the rotational speed of the engine crankshaft. For instance, the speed sensor 36 may comprise a variable reluctance transducer co-operating with teeth on a flywheel of the engine.

The control circuit 32 has outputs connected to a fuel injection actuator 37 and a spark circuit 38, so that the control system shown in FIG. 13 forms an engine management system for a spark-ignition internal combustion engine. The system may also be used with a compression-ignition (diesel) engine, in which case the spark circuit 38 is not required and ignition timing is controlled by controlling the beginning of fuel injection.

The control circuit 32 may be based on digital and/or analog circuitry, and preferably includes a microprocessor or microcomputer controlled by software stored in read-only memory.

During normal driving operation of the vehicle, a driver operates the accelerator 34 and the potentiometer 33 supplies a load demand signal to the control circuit 32. The control circuit 32 receives signals from the sensors 35 and 36, and possibly from other sensors not shown responding to other engine and/or transmission parameters of the vehicle, and derives from these signals a throttle position demand signal which is supplied to the differential amplifier 31. The differential amplifier 31 provides an error signal representing the difference between the demanded throttle position and the actual throttle position determined by the potentiometer 4, and the drive amplifier 30 drives the torque motor 3 in accordance with the error signal. The drive amplifier 30 may have any suitable transfer function, for instance representing a combination of proportional, integral, and differential transfer functions. The motor 3 is thus driven in a direction such as to eliminate or reduce the error signal so that the throttle butterfly 2 adopts the demanded position.

The single-valued transfer function of the actuator permits unconditionally stable closed loop operation to be readily achieved. However, in the event of a failure which causes the loss of the position feedback signal to the inverting input of the differential amplifier 31, the system continues to operate in open loop mode and the vehicle remains drivable albeit with impaired performance of the control system. Also, the arrangement of the torque motor is such as to allow torque motor current to remain below a maximum value, for instance 3.5 amps.

We claim:

1. A throttle actuator comprising a throttle which is pivotable over a range of angular positions between a closed position and a fully open position, a return spring providing a throttle-closing bias force, and a torque motor for driving said throttle, said throttle actuator having a single-valued transfer function of throttle angular position against torque motor current over said range of angular positions of said throttle.

2. A throttle actuator as claimed in claim 1, in which said throttle-closing bias force of said return spring increases monotonically with increasing angular displacement of said throttle from said closed position and said torque motor has a transfer characteristic of motor torque against throttle angular position such that, for each value of torque motor current not greater than a predetermined maximum value, the motor torque decreases monotonically with increasing angular displacement of said throttle from said closed position.

3. A throttle actuator as claimed in claim 1, in which said torque motor produces zero torque for zero torque motor current throughout said range of angular positions of said throttle.

4. A throttle control system comprising a throttle actuator as claimed in claim 1 and a control circuit for controlling said throttle actuator in accordance with a throttle demand signal.

5. A throttle control circuit as claimed in claim 4, in which said throttle actuator includes a throttle position transducer for supplying to said control circuit a signal representing actual throttle position, said control circuit being arranged to drive said torque motor in accordance with a difference between the actual throttle position and a demanded throttle position corresponding to the demand signal.

* * * * *